US006605695B2

(12) United States Patent
Takasaki et al.

(10) Patent No.: US 6,605,695 B2
(45) Date of Patent: Aug. 12, 2003

(54) PROCESS OIL, PROCESS FOR PRODUCING THE SAME AND RUBBER COMPOSITION

(75) Inventors: Masami Takasaki, Chiba (JP); Meishi Tanaka, Chiba (JP); Hisao Anzai, Chiba (JP); Masashi Nakamura, Chiba (JP); Chisato Endo, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 10/078,665

(22) Filed: Feb. 21, 2002

(65) Prior Publication Data

US 2002/0188054 A1 Dec. 12, 2002

Related U.S. Application Data

(62) Division of application No. 09/499,676, filed on Feb. 8, 2000, now Pat. No. 6,399,697.

(30) Foreign Application Priority Data

Feb. 26, 1999 (JP) ..... 11-050180
Feb. 26, 1999 (JP) ..... 11-050181

(51) Int. Cl.[7] ..... C01G 21/00

(52) U.S. Cl. ..... 528/833; 528/2; 528/835; 528/863

(58) Field of Search ..... 524/575, 575.5, 524/848, 474, 484; 528/2, 833, 835, 863

(56) References Cited

U.S. PATENT DOCUMENTS 6,248,929 B1 * 6/2001 Kaimai et al. ..... 585/241

FOREIGN PATENT DOCUMENTS

| | | | |
|---|---|---|---|
| EP | 0 417 980 | 3/1991 | |
| EP | 417980 | * 3/1991 | ..... C10G/21/00 |
| EP | 839891 | * 10/1997 | ..... C10G/21/28 |
| EP | 0 839 891 | 5/1998 | |
| EP | 0 933 418 | 8/1999 | |
| EP | 0 950 703 | 10/1999 | |

* cited by examiner

*Primary Examiner*—Kelechi Egwim
(74) *Attorney, Agent, or Firm*—Oblon, Spivak, McClelland, Maier & Neustadt, P.C.

(57) ABSTRACT

A process oil which satisfies the requirements of (a) a content of a polycyclic aromatic compound of less than 3% by weight, (b) a content of an aromatic hydrocarbon of 18% by weight or more, (c) a content of a polar compound ranging from 11 to 25% by weight, (d) a kinematic viscosity at 100° C. ranging from 10 to 70 $mm^2/s$, and (e) a flash point of 210° C. or more.

5 Claims, No Drawings

PROCESS OIL, PROCESS FOR PRODUCING THE SAME AND RUBBER COMPOSITION

This application is a division of application Ser. No. 09/499,676 filed on Feb. 8, 2000 now U.S. Pat. No. 6,399,697.

BACKGROUND OF THE INVENTION

1. Field of the Invention

The present invention relates to process oil, a process for producing the same, and a rubber composition containing the process oil or the process oil obtained by the process. More specifically, it relates to process oil in which a content of polycyclic aromatic compounds (PCA) is less than 3% by weight and which maintains an ordinary performance, a process for producing the same, and a rubber composition.

The present invention further relates to rubber process oil which is process oil used in rubber processing, and a rubber composition. More specifically, it relates to rubber process oil having a reduced content of polycyclic aromatic compounds (PCA) and having an excellent performance, and a rubber composition containing the same.

2. Description of the Related Art

Process oil is used as oil for processing a natural rubber or a synthetic rubber, an extender thereof, a plasticizer of a thermoplastic resin, a solvent of printing ink or a softening agent of regenerated asphalt. Accordingly, process oil having specific properties such as a viscosity, a density, a volatility and a compatibility with a rubber according to each use has been in demand. For example, when process oil is used for a rubber (namely, as rubber process oil), it has been deemed good that process oil is good in a compatibility with a rubber for improvement of the processability, has a viscosity according to the use and is excellent in a durability. For this reason, an extract with a high aromatic content which is formed as a by-product in producing a lubricant fraction (raffinate) by solvent extraction from feedstock free of residue such as vacuum distillate or deasphalted oil has been used.

The toxicity of polycyclic aromatic compounds (PCA) has been recently a problem. Since especially process oil used for automobile tire involves the environmental pollution as tire dust, it has been required to reduce PCA in process oil. However, large amounts of the polycyclic aromatic compounds are contained in an extract with the high aromatic content produced by the process. Accordingly, process oil with PCA reduced and a process for producing the same have been in urgent demand.

Therefore, the development of process oil with PCA reduced has proceeded. For example, International Patent Publication No. 505524/1994 discloses a rubber composition using process oil with low PCA. The process oil disclosed therein is produced using deasphalted oil as feedstock, and it has a high viscosity. Accordingly, its use is limited.

Further, EP 417980A1 discloses a process for producing process oil with low PCA and high aromatic hydrocarbon by a two-step extraction process using a polar solvent. This process has however suffered problems that a density of a primary extract, a raw material of an extraction at a second stage, is close to that of a polar solvent and an affinity for a polar solvent is strong so that it is quite difficult to set extraction conditions and an extraction efficiency is poor (according to Examples, a maximum yield is 51%).

As a process similar to this process, EP 0839891A2 discloses a process for producing process oil in which a PCA content is less than 3% by weight. It describes that process oil is obtained in which a kinematic viscosity at 100° C. is in a wide range of 2 to 70 cSt and a total amount of an aromatic hydrocarbon and a polar substance is 40% by weight or more, the polar substance being not higher than 10% by weight. With respect to a process for producing the process oil, an extract formed as a by-product in producing a lubricant fraction (raffinate) by solvent extraction using vacuum distillate and/or deasphalted oil as feedstock is further extracted to provide the process oil. The process is intricate, and a yield of the process oil is low as a whole.

Further known as a related art are a process in which a non-carcinogenic bright stock extract and/or deasphalted oil is produced from atmospheric residue feedstock (International Patent Publication No. 501346/1995), a process in which a mutagenicity of polycyclic aromatic compounds is reduced through alkylation (International Patent Publication No. 503215/1996), a rubber composition using aromatic oil of low polycyclic aromatic compounds (PCA) obtained by treating a vacuum distillate (350 to 600° C.) of crude oil from the Middle East (International Patent Publication No. 505524/1994 and WO 92/14479), and a process for producing low PCA process oil made of a mononuclear or dinuclear aromatic hydrocarbon compound (EP 0489371B1 and DE 4038458C2).

As stated above, rubber process oil is a type of process oil, and is blended for improving a processability by increasing a plasticity of a rubber or decreasing a hardness of a vulcanized rubber. For the rubber process oil, a compatibility with a rubber is required.

A safety of a product is, as described above, also required for the rubber process oil, and the use of highly refined mineral oil in which the content of the polycyclic aromatic compound is less than 3% by weight is requested. However, the use of ordinary mineral oil which is refined such that the content of the polycyclic aromatic compound is adjusted to less than 3% by weight is problematic in that a compatibility with an aromatic rubber is poor and that when a rubber is blended with this oil, oil is bled in a vulcanized rubber to decrease heat aging properties of the vulcanized rubber. Further, from the aspect of a workability, it is required that a viscosity is kept to be as low as that of ordinary oil. Accordingly, rubber process oil in which the content of the polycyclic aromatic compound is less than 3% by weight, the viscosity of current oil is maintained and a compatibility with an aromatic rubber is excellent has been in demand.

SUMMARY OF THE INVENTION

The present invention aims to provide process oil in which PCA is reduced and properties required for current process oil, such as a processability and a bleed resistance of a rubber, are excellent, a process for efficiently producing the process oil using residual oil as feedstock, and a rubber composition containing the process oil or the process oil obtained by the process.

The present invention further aims to provide process oil in which a PCA content is less than 3% by weight, a viscosity of ordinary oil is maintained and a compatibility with an aromatic rubber is excellent, and a rubber composition in which bleeding does not occur in a vulcanized rubber containing the same and heat aging properties are excellent.

The present inventors have assiduously conducted investigations, and have consequently found that residual oil is mixed with lubricant base oil and the mixture is extracted with a solvent to obtain excellent process oil with a low PCA content that satisfies the aims. This finding has led to the completion of the present invention.

The present inventors have further assiduously conducted investigations, and have consequently found that oil having specific properties becomes excellent rubber process oil that satisfies the aims. This finding has led to the completion of the present invention.

That is, the gist of the present invention is as follows. (1) Process oil which satisfies requirements that (a) a content of a polycyclic aromatic compound is less than 3% by weight, (b) a content of an aromatic hydrocarbon is 18% by weight or more, (c) a content of a polar compound is between 11 and 25% by weight, (d) a kinematic viscosity at 100° C. is between 10 and 70 $mm^2/s$, and (e) a flash point is 210° C. or more; (2) a process for producing process oil having a content of a polycyclic aromatic compound of less than 3% by weight, which comprises extracting mixed oil made of 20 to 90% by volume of residual oil and 10 to 80% by volume of lubricant base oil with a polar solvent; (3) the process for producing process oil as recited in (2), wherein the process oil further satisfies requirements that (b) a content of an aromatic hydrocarbon is 18% by weight or more, (c') a content of a polar compound is 25% by weight or less, and (d) a kinematic viscosity at 100° C. is between 10 and 70 $mm^2/s$; (4) the process for producing process oil as recited in (2) or (3), wherein the extraction is conducted by a countercurrent contact method with an extraction column using furfural as a polar solvent under conditions that a solvent ratio is between 0.5 and 2.5, an extraction column top temperature is between 60 and 115° C., an extraction column bottom temperature is between 45 and 80° C., and the extraction column top temperature is higher than the extraction column bottom temperature; (5) the process for producing process oil as recited in any of (2) to (4), wherein the process oil satisfies the requirements as recited in (1); (6) rubber process oil in which (a) a content of a polycyclic aromatic compound is less than 3% by weight, (b') a content of an aromatic hydrocarbon according to ASTM D 2007 is between 25 and 35% by weight, (c") a content of a polar compound according to ASTM D 2007 is between 15 and 20% by weight, (d') a kinematic viscosity at 100° C. is in the range of 20 to 32 $mm^2/s$, (e') a flash point (COC) is 230° C. or more, and (f) a 5 volume % distillation temperature is between 370 and 530° C.; (7) a rubber composition obtained by blending a rubber with 10 to 25% by weight, based on the total amount of the rubber composition, of the rubber process oil as recited in (6); and (8) the rubber composition as recited in (7), wherein 50% by weight or more of the rubber is a styrene-butadiene rubber.

DETAILED DESCRIPTION OF THE INVENTION

First, the main composition and properties of process oil of the present invention are described.

(a) Polycyclic Aromatic Compound (PCA)

In the process oil of the present invention, the PCA content has to be less than 3% by weight. In Europe, the handling of mineral oil containing 3% or more of PCA is limited in view of the problem of carcinogenicity, and this is the same with the process oil. Incidentally, the PCA content is measured by the method (IP 346/92) of Institute of Petroleum.

(b) Aromatic Hydrocarbon

The content of the aromatic hydrocarbon is 18% by weight or more, preferably 20% by weight or more. The aromatic hydrocarbon content is an important requirement that influences an affinity for, and a compatibility with, a rubber. When a rubber is blended with process oil, the aromatic hydrocarbon is effective for improving a processability and an extending property of a rubber. Further, it is effective for improving a compatibility with a resin when process oil is used as an ingredient of printing ink. The content of the aromatic hydrocarbon is measured according to ASTM D 2007.

(c) Polar Compound

The content of the polar compound is 25% by weight or less, preferably between 11 and 25% by weight, more preferably between 13 and 25% by weight. When the content of the polar compound is too high, properties of a rubber might be impaired in blending with a rubber. When the polar compound is contained in an amount of 11% by weight or more, it is also effective for improving a compatibility in blending with a rubber in spite of the relatively low content of the aromatic hydrocarbon. The content of the polar compound is measured according to ASTM D 2007.

(d) Kinematic Viscosity

The kinematic viscosity at 100° C. is between 10 and 70 $mm^2/s$, preferably between 20 and 60 $mm^2/s$. When the kinematic viscosity is lower than 10 $mm^2/s$, ordinary properties of a vulcanized rubber are decreased. When it is higher than 70 $mm^2/s$, a processability and an operability in blending with a rubber become poor. Especially, in case of an aromatic vulcanized rubber, when the process oil having this range of the kinematic viscosity is appropriately used according to properties of the rubber, the prevention of bleeding of a plasticizer from the vulcanized rubber can be improved. The kinematic viscosity is measured according to ASTM D 445.

(e) Flash Point

In the process oil of the present invention, it is inevitable that the flash point is 210° C. or more. In the process for producing process oil in the present invention, it is preferable that the flash point is 210° C. or more. When the flash point is low, an flammability is increased in handling the process oil, and an equipment for preventing the same is required. Thus, it is undesirable. The flash point is measured according to ASTM D 92 (COC°C.).

(f) 5 Volume % Distillation Temperature

It is advisable that among the distillation properties, the 5 volume % distillation temperature is in the range of 370 to 530° C. When it is lower than 370° C., evaporation easily occurs, and the evaporation of oil worsens heat aging properties in blending with a rubber. The 5 volume % distillation temperature is also a rough index of a kinematic viscosity. When it is higher than 530° C., the kinematic viscosity is also increased, worsening an operability in blending with a rubber. The 5 volume % distillation temperature is measured according to ASTM D 2887.

(g) Density

The density is preferably between 0.870 and 0.970 $g/cm^3$, more preferably between 0.900 and 0.960 $g/cm^3$. When the density of the process oil is different from that of the ordinary product in blending with a rubber or ink, the blending procedure has to be changed. Thus, from a practical standpoint, it has to be in an appropriate range. The density is measured according to ASTM D 4052.

The process for producing process oil is described below.

When the process for producing process oil in the present invention is employed, process oils having various compositions and properties can be produced according to purposes. At least the requirement described at the above-mentioned gist (2) has to be satisfied.

Residual oil which is a raw material of process oil in the process of the present invention may be generally distillated residual oil of a mineral oil. That is, it includes atmospheric residue and vacuum residual oil of various crude oils, and deasphalted oil obtained by further deasphalting these residual oils with lower hydrocarbons. Of these, vacuum residual oil or/and its deasphalted oil are preferable raw materials. With respect to the properties of residual oil, it is preferable that a content of asphaltene is between 0.1 and 2.0% by weight, a PCA content is 20% by weight or less, a content of an aromatic hydrocarbon is 20% by weight or more, a kinematic viscosity at 100° C. is between 60 and 400 $mm^2/s$, a density is between 0.900 and 1.200 $g/cm^3$, and a 5 volume % distillation temperature is 370° C. or more.

Lubricant base oil as a second raw material may be lubricant base oil of a mineral oil type obtained in a general lubricant refining process. That is, it can be formed by refining fractions obtained by subjecting various crude oils to atmospheric distillation, vacuum distillation or deasphalting through a solvent refining, hydrogenation refining or hydrocracking process and, as required, a dewaxing process. With respect to the properties of the lubricant base oil, it is preferable that a PCA content is 10% by weight or less, a content of an aromatic hydrocarbon is 5% by weight or more, a kinematic viscosity at 100° C. is between 5 and 70 $mm^2/s$, a density is between 0.860 and 1.000 $g/cm^3$, and a 5 volume % distillation temperature is in the range of 370 to 530° C.

Residual oil is mixed with lubricant base oil to form mixed oil as a raw material of extraction treatment. It is not desirable that mixed oil as a raw material contains other ingredients. However, it is not that the present invention cannot be practiced with this mixed oil. With respect to the mixing ratio, it is required that based on the mixed oil, the residual oil is between 20 and 90% by volume, preferably between 40 and 80% by volume, and the lubricant base oil is between 10 and 80% by volume, preferably between 20 and 60% by volume. With respect to the composition and the properties of the mixed oil obtained by mixing the two fractions, it is preferable that a PCA content is between 3 and 20% by weight, a content of an aromatic hydrocarbon is between 15 and 40% by volume, a content of a polar compound is between 5 and 30% by weight, a kinematic viscosity at 100° C. is between 10 and 100 $mm^2/s$, and a 5 volume % distillation temperature is 370° C. or more. It is advisable that a content of asphaltene is 2.0% by weight or less. By the way, the PCA content is measured by the method (IP 346/92) of Institute of Petroleum. The content of the aromatic hydrocarbon and the content of the polar compound are measured according to ASTM D 2007.

The mixed oil is extracted with a polar solvent to obtain desired process oil in which the PCA content is less than 3% by weight. In this extraction treatment, it is advisable to use a continuous extraction column, especially a countercurrent contact method extraction column. Usually, a countercurrent contact method extraction column of RDC (rotary disk contactor) type can be used. The polar solvent is not particularly limited. Furfural, phenol or N-methylpyrrolidone can preferably be used. Of these, furfural is especially preferable.

The conditions of the extraction treatment can be selected, as required, according to an extraction method, an extraction solvent and mixed oil as an extraction raw material. It is preferable that the extraction method is a countercurrent contact method and an extraction solvent is furfural. In this case, it is preferable that a solvent ratio (solvent/mixed oil volume ratio) is between 0.5 and 2.5, preferably between 1.0 and 2.0, an extraction column top temperature is between 60 and 115° C., preferably 70 and 110° C., an extraction column bottom temperature is between 45 and 80° C., preferably between 50 and 70° C., and the top temperature is higher than the bottom temperature.

By this treatment, PCA undesirable in process oil is separated and removed from the bottom of the extraction column along with other impurities such as asphaltene, and the solvent is separated from the fraction (raffinate) obtained from the top to provide desired process oil in which a PCA content is less than 3% by weight. In this case, higher-performance process oil can be obtained by conducting distillation treatment, dewaxing treatment or secondary finishing treatment as required. Process oil having the composition and the properties that a content of an aromatic hydrocarbon is 18% by weight or more, preferably 20% by weight or more, a content of a polar compound is 25% by weight or less, preferably between 11 and 25% by weight, more preferably between 13 and 25% by weight, a kinematic viscosity at 100° C. is between 10 and 70 $mm^2/s$, preferably between 20 and 60 $mm^2/s$, a flash point is preferably 210° C. or more, and a PCA content is less than 3% by weight can be produced by adjusting feedstock and extraction conditions in the process as required.

The process that satisfies the conditions can preferably be employed as the process for producing process oil in the present invention. The thus-produced process oil can preferably be used as process oil for production of natural rubber articles and synthetic rubber articles or as process oil having the low PCA content in a plasticizer of a thermoplastic resin. Further, it can also be used as a solvent of printing ink or a softening agent of regenerated asphalt.

The rubber process oil of the present invention is described below.

The rubber process oil of the present invention can be realized as products having various compositions and properties according to a process. It is required to satisfy at least all of conditions (a), (b'), (c"), (d'), (e') and (f) which will be described in order.

(a) Content of a Polycyclic Aromatic Compound

The content of the polycyclic aromatic compound in the rubber process oil of the present invention has to be, as stated above, less than 3% by weight in view of the problem of the environment. The content of the polycyclic aromatic compound here referred to is measured by the IP 346/92 method.

(b') Content of an Aromatic Hydrocarbon

The content of the aromatic hydrocarbon in the rubber process oil of the present invention has to be between 25 and 35% by weight, and it is preferably between 26 and 32% by weight, more preferably between 26 and 29% by weight. When the content of the aromatic hydrocarbon is too high, there is a high possibility that the content of the polycyclic aromatic compound becomes 3% by weight or more, and it is thus undesirable. Further, when it is too low, a compatibility with a rubber is poor, bleeding occurs in a vulcanized rubber containing process oil, and ordinary properties and heat aging properties are also deteriorated. Thus, it is undesirable. The content of the aromatic hydrocarbon here referred to is a value measured by ASTM D 2007 (clay-gel analytical method).

(c") Content of a Polar Compound

The content of the polar compound has to be between 15 and 20% by weight, and it is preferably between 16 and 20% by weight. When the content of the polar compound is too high, properties of a rubber might be impaired in blending with a rubber. When it is too low, a compatibility with a rubber is poor, and there is a possibility that bleeding occurs in a vulcanized rubber. The content of the polar compound here referred to is a value measured according to ASTM D 2007 (clay-gel analytical method).

(d') Kinematic Viscosity

In the rubber process oil of the present invention, it is important that the kinematic viscosity at 100° C. is between 20 and 32 $mm^2/s$. It is especially preferably between 25 and 31 $mm^2/s$ When the kinematic viscosity is too low, ordinary properties of a vulcanized rubber are decreased as compared with those of ordinary oil, and heat aging properties are decreased by evaporation of oil in the heat aging. Meanwhile, when it is too high, a fluidity is low, and the handling is difficult. The kinematic viscosity is a value measured according to ASTM D 445.

(e') Flash Point (COC)

In the rubber process oil of the present invention, the flash point (COC) has to be 230° C. or more, and it is preferably 250° C. or more. When the flash point is too low, there is a high possibility of ignition in handling, and an equipment for preventing the same is required. Thus, it is undesirable. The flash point is a value measured according to ASTM D 92.

(f) 5 Volume % Distillation Temperature

In the rubber process oil of the present invention, the 5 volume % distillation temperature has to be between 370 and 530° C., and it is preferably between 400 and 450° C. When this 5 volume % distillation temperature is too low, the heat aging properties are decreased by evaporation of oil in the heat aging. Thus, it is undesirable. Meanwhile, when it is too high, the kinematic viscosity of oil is increased. Thus, it is undesirable in view of a workability. The 5 volume % distillation temperature is a value measured by the distillation test method of JIS K 2254 (gas chromatography: corresponding to ASTM D 2887).

When the rubber process oil of the present invention satisfies at least these conditions, general properties other than these are not particularly limited.

As a process for producing the rubber process oil in the present invention, the process for producing process oil can be mentioned. The rubber process oil of the present invention can be produced by this process at good efficiency.

Finally, the rubber composition of the present invention is described.

The rubber composition of the present invention is obtained by blending a rubber with the process oil of the present invention, the process oil obtained by the process of the present invention or the rubber process oil of the present invention in an amount of 10 to 25% by weight. The type of the rubber is not particularly limited, and it may be either a natural rubber or a synthetic rubber. Examples of the synthetic rubber can include a styrene-butadiene rubber (SBR), a chloroprene rubber (CR), a isoprene rubber (IR), an isobutylene-isoprene rubber (IIR), an ethylene-propylene rubber (EPR) and an ethylene-propylene-diene monomer (EPDM). Of these, aromatic rubbers such as SBR are preferable. A rubber containing 50% by weight or more of SBR is preferable.

The thus-obtained rubber composition of the present invention is free from oil bleeding, and excellent in the heat aging properties.

The process oil of the present invention has the content of the polycyclic aromatic compound of less than 3% by weight and exhibits excellent properties which are the same as those of ordinary process oil. Accordingly, it can be used as process oil for a rubber, a plasticizer of a thermoplastic resin, an ingredient of printing ink or a softening agent of regenerated asphalt. Further, the process for producing process oil in the present invention can produce process oil having the content of the polycyclic aromatic compound of less than 3% by weight with good productivity.

The rubber process oil of the present invention has the content of the polycyclic aromatic compound of less than 3% by weight, maintains the viscosity of ordinary oil, and is excellent in the compatibility with the aromatic rubber. Further, the vulcanized rubber containing the same is free from bleeding, and excellent in the heat aging resistance.

EXAMPLES

The present invention is described more specifically below with reference to the following Examples. However, the present invention is not limited to these Examples at all.

[Production of Mixed Oil]

Mixed oils C to H were produced using vacuum residual oil VR and lubricant base oils A and B having properties shown in Table 1 as raw materials. A mixing ratio of a raw material of each mixed oil and properties thereof are shown in Table 2.

Examples 1 to 9

Each mixed oil was extracted with furfural using a countercurrent contact extraction column of RDC (rotary disk contactor) type, and furfural mixed was removed from a product (raffinate) through distillation to obtain process oil. The extraction conditions and the properties of process oil obtained in each Example are shown in Tables 3 and 4.

Comparative Examples 1 and 2

Process oils were obtained in the same manner as in Example 1 using an extract EX (Comparative Example 1) and vacuum distillate (Comparative Example 2) having properties shown in Table 1 as raw materials. The conditions of the extraction treatment are shown in Table 4. The properties of process oils obtained are shown in Table 4.

TABLE 1

| | Properties of feedstock | | | | |
|---|---|---|---|---|---|
| Feedstock | Vacuum residual oil VR | Lubricant base oil A | Lubricant base oil B | Extract EX | Vacuum distillation oil |
| Density (15° C.) ($g/cm^3$) | 0.9857 | 0.8741 | 0.9378 | 1.0141 | 0.954 |
| Kinematic viscosity | | | | | |
| (40° C.)($mm^2/s$) | 21110 | 87.5 | 202.4 | 976.3 | 264.5 |
| (100° C.)($mm^2/s$) | 252.5 | 10.64 | 11.67 | 23.8 | 12.5 |
| Pour point (ASTM D 97) (° C.) | 20.0 | −15.0 | −22.5 | 12.5 | −12.5 |
| Aniline point (ASTM D 611) (° C.) | — | 118.9 | 76.5 | 29.5 | 67.2 |
| Flash point (ASTM D 92) (COC° C.) | 314 | 270 | 248 | 256 | 234 |
| Refractive index (ASTM D 1218) (20° C.) | 1.5585 | 1.4804 | 1.5165 | 1.575 | 1.5295 |
| Carbon-type distribution (n-d-M) (ASTM D 3238) | | | | | |
| % $C_A$ | 40.1 | 2.7 | 18.0 | 48.0 | 25.5 |
| % $C_N$ | 1.9 | 27.6 | 37.7 | 3.3 | 32.7 |
| % $C_P$ | 58.0 | 69.7 | 44.3 | 48.7 | 41.8 |
| Aromatic hydrocarbon (wt. %) | 33.59 | 11.0 | 38.7 | 81.2 | — |
| Polar compound (wt. %) | 29.37 | — | — | — | — |
| Polycyclic aromatic compound (wt. %) | 13.5 | 0.32 | 4.9 | 19.3 | 11.6 |
| Asphaltene (wt. %) | 0.5 | — | — | — | — |

TABLE 2

| Mixing ratio and properties of mixed oil | | | | | | | |
|---|---|---|---|---|---|---|---|
| Mixed oil | | C | D | E | F | G | H |
| Mixing ratio (vol. %) | Vacuum residual oil VR | 80 | 70 | 60 | 50 | 30 | 70 |
| | Lubricant base oil A | 20 | 30 | 40 | 50 | 70 | — |
| | Lubricant base oil B | — | — | — | — | — | 30 |
| Density 15° C. (g/cm$^3$) | | 0.9614 | 0.9499 | 0.9388 | 0.9277 | 0.9062 | 0.9718 |
| Kinematic viscosity | | | | | | | |
| (40° C.)(mm$^2$/s) | | 4850 | 2528 | 1226 | 688.3 | 260.7 | 3818.0 |
| (100° C.)(mm$^2$/s) | | 90.61 | 74.67 | 44.47 | 32.89 | 19.46 | 78.21 |
| Flash point (ASIM D 92) (COC° C.) | | — | 290 | 284 | 272 | 272 | — |
| Refractive index (ASTM D 1218) (20° C.) | | 1.5429 | 1.6351 | 1.5269 | 1.5195 | 1.5038 | 1.5459 |
| Carbon-type distribution (n-d-M)(ASTM D 3238) | | | | | | | |
| % $C_A$ | | 33.1 | 29.3 | 25.4 | 21.7 | 14.1 | 33.9 |
| % $C_N$ | | 6.8 | 9.3 | 11.9 | 14.3 | 19.2 | 12.6 |
| % $C_P$ | | 60.1 | 61.4 | 62.7 | 64.0 | 53.1 | 53.5 |
| Aromatic hydrocarbon (wt. %) | | 29.07 | 28.0 | 26.0 | 24.2 | 20.4 | 35.1 |
| Polar compound (wt. %) | | 23.5 | 21.0 | 17.0 | 15.8 | 10.2 | 20.6 |
| Polycyclic aromatic compound (wt. %) | | 10.9 | 9.5 | 8.2 | 6.9 | 4.3 | 10.9 |

TABLE 3

| Examples (Extraction conditions and yield and properties of process oil) | | | | | | | |
|---|---|---|---|---|---|---|---|
| Example | | 1 | 2 | 3 | 4 | 5 | 6 |
| Extraction conditions | Mixed oil | E | E | E | E | F | D |
| | Solvent ratio (volume ratio) | 1.5 | 1.5 | 1.5 | 1.0 | 1.5 | 2.0 |
| | Extraction column top temperature (° C.) | 80 | 90 | 90 | 90 | 90 | 90 |
| | Extraction column bottom temperature (° C.) | 60 | 60 | 65 | 65 | 60 | 60 |
| Yield of process oil (vol. %) | | 78 | 72 | 70 | 78 | 79 | 61 |
| Properties of process oil | Density (15° C.)(g/cm$^3$) | 0.9230 | 0.9228 | 0.9191 | 0.9237 | 0.9160 | 0.9304 |
| | Kinematic viscosity (100° C.)(mm$^2$/s) | 26.86 | 26.13 | 27.17 | 29.37 | 17.51 | 35.90 |
| | Flash point (ASTM D 92)(COC° C.) | 286 | 282 | 280 | 283 | 270 | 288 |
| | Carbon-type distribution (n-d-M) (ASTM D 3238) | | | | | | |
| | % $C_A$ | 17.5 | 17.6 | 17.8 | 19.4 | 16.8 | 17.2 |
| | % $C_N$ | 21.8 | 21.3 | 17.9 | 16.9 | 20.2 | 22.7 |
| | % $C_P$ | 60.7 | 61.1 | 64.3 | 63.7 | 63.0 | 60.1 |
| | Aromatic hydrocarbon (wt. %) | 27.0 | 27.2 | 27.5 | 28.9 | 26.0 | 26.6 |
| | Polar compound (wt. %) | 16.6 | 16.7 | 16.9 | 17.7 | 15.9 | 16.3 |
| | Polycyclic aromatic compound (wt. %) | 2.8 | 2.3 | 2.1 | 2.9 | 1.9 | 2.8 |

TABLE 4

| Examples and Comparative Examples (Extraction conditions and yield and properties of process oil) | | | | | | |
|---|---|---|---|---|---|---|
| Example (Ex.), Comparative Example CEx.) | | Ex. 7 | Ex. 8 | Ex. 9 | CEx. 1 | CEx. 2 |
| Extraction conditions | Mixed oil (feedstock) | C | H | G | Extract EX | Vacuum distillation oil |
| | Solvent ratio (volume ratio) | 2.0 | 2.0 | 1.5 | 1.0 | 0.6 |
| | Extraction column top temperature (° C.) | 100 | 100 | 90 | 65 | 60 |

TABLE 4-continued

Examples and Comparative Examples
(Extraction conditions and yield and properties of process oil)

| Example (Ex.), Comparative Example CEx.) | | Ex. 7 | Ex. 8 | Ex. 9 | CEx. 1 | CEx. 2 |
|---|---|---|---|---|---|---|
| | Extraction column bottom temperature (° C.) | 65 | 65 | 60 | 50 | 40 |
| Yield of process oil vol. % | | 38.9 | 42.1 | 90.1 | 10 | 84 |
| Properties of process oil | Density (15° C.)(g/cm$^3$) | 0.9347 | 0.9448 | 0.8985 | 0.9941 | 0.9378 |
| | Kinematic viscosity (100° C.)(mm$^2$/s) | 46.43 | 40.08 | 6.179 | 19.95 | 11.67 |
| | Flash point (ASTM D 92) (COC° C.) | 292 | 268 | 270 | 258 | 248 |
| | Carbon-type distribution (n-d-M) (ASTM D 3238) | | | | | |
| | % $C_A$ | 17.5 | 17.9 | 15.2 | 39.0 | 18.0 |
| | % $C_N$ | 22.6 | 28.8 | 18.0 | 22.1 | 37.7 |
| | % $C_P$ | 59.9 | 53.3 | 66.8 | 38.9 | 44.3 |
| | Aromatic hydrocarbon (wt. %) | 27.0 | 27.2 | 23.5 | 71.0 | 38.7 |
| | Polar compound (wt. %) | 16.6 | 17.0 | 14.4 | — | — |
| | Polycyclic aromatic compound (wt. %) | 2.5 | 2.7 | 0.3 | 13.6 | 4.9 |

Next, rubber process oil and a rubber composition are specifically described with reference to the following Examples.

(1) Production of Rubber Process Oil

Example 10

Sixty percent by volume of mineral oil-type vacuum residual oil containing 0.3% by weight of asphaltene and 40% by volume of lubricant base oil containing 0.5% by weight of a polycyclic aromatic compound with a kinematic viscosity at 40° C. of 90 mm$^2$/s were mixed, and the mixture was then extracted under conditions shown in Table 5 using furfural as a solvent. Furfural mixed was removed from the resulting raffinate to form rubber process oil. The properties thereof are shown in Table 5.

Example 11

Rubber process oil was obtained in the same manner as in Example 10 except that the solvent ratio (solvent/mixed oil volume ratio) was 1.5. A mixing ratio of a raw material, extraction conditions and properties of rubber process oil are shown in Table 5.

Comparative Example 3

Properties of an ordinary product (commercial aromatic oil A) are shown in Table 5.

TABLE 5

| | Example (Ex.), Comparative Example (CEx.) | | |
|---|---|---|---|
| | Ex. 10 | Ex. 11 | CEx. 3 |
| Mixing ratio (vol. %) | | | |
| Vacuum residual oil | 60 | 60 | — |
| Lubricant base oil | 40 | 40 | — |
| Extraction conditions | | | |
| Solvent ratio (volume ratio) | 1.0 | 1.5 | — |

TABLE 5-continued

| | Example (Ex.), Comparative Example (CEx.) | | |
|---|---|---|---|
| | Ex. 10 | Ex. 11 | CEx. 3 |
| Extraction column top temperature (° C.) | 90 | 90 | — |
| Extraction column bottom temperature (° C.) | 65 | 65 | — |
| Properties of process oil | | | |
| Content of polycyclic aromatic compound (wt. %) | 2.9 | 2.6 | 15.6 |
| Kinematic viscosity (mm$^2$/s) (at 100° C.) | 30.26 | 26.18 | 24.02 |
| Flash point (COC) (° C.) | 280 | 278 | 258 |
| 5 volume % distillation temperature (° C.) | 435.2 | 440.8 | 431.6 |
| Content of aromatic hydrocarbon (wt. %) | 28.7 | 27.5 | 81.2 |
| Content of polar compound (wt. %) | 17.4 | 16.8 | 9.7 |
| Density (at 15° C.) | 0.9240 | 0.9235 | 1.015 |
| Total acid value (mg KOH/g) | 0.37 | 0.35 | 0.01 |
| Pour point (° C.) | −20.0 | −20.0 | 10.0 |
| Aniline point (° C.) | 103.0 | 103.5 | 27.0 |
| Carbon-type distribution (n-d-M) | | | |
| % $C_A$ | 19.2 | 18.0 | 43.0 |
| % $C_N$ | 17.2 | 20.6 | 33.0 |
| % $C_P$ | 63.6 | 61.4 | 24.0 |

(2) Evaluation of Properties of a Rubber Composition

Rubber kneading and vulcanization were conducted with the following general SBR formulation for a tire tread using the rubber process oil in each of Examples 10 and 11 and Comparative Example 3. The ordinary properties, the bleeding property and the heat aging properties were evaluated. The results are shown in Tables 7 and 8.

Rubber Kneading Formulation

The ingredients and the mixing ratio are shown in Table 6.

TABLE 6

| Ingredients | Maker, Trade name | Mixing ratio (parts by weight) |
|---|---|---|
| (1) SBR | Japan Synthetic Rubber Co., Ltd., JSR 1500 | 100 |
| (2) Carbon black | Asahi Carbon, #70 (HAF) | 50 |
| (3) ZnO No. 3 | Commercial product | 3 |
| (4) Stearic acid | Commercial product | 2 |
| (5) Rubber process oil | | 40 |
| (6) Sulfur | Commercial product | 2 |
| (7) Vulcanization accelerator | Ohuchi Shinko Kagaku K.K., NOCCELER CZ | 1 |

Rubber Kneading

Ingredient (1) was kneaded with a Banbury mixer for 1 minute, and plasticized. Then, this was mixed with ingredients (2) to (5), and the mixture was kneaded with a Banbury mixer for 4 minutes. Subsequently, the mixture was mixed with ingredients (6) and (7), and the resulting mixture was kneaded with a twin roll for 10 minutes to obtain an unvulcanized rubber.

Vulcanization

The unvulcanized rubber was vulcanized with a vulcanization press at 145° C. for 60 minutes to obtain a rubber sheet having a thickness of 2 mm.

Evaluation of Properties

A dumbbell specimen according to JIS No. 3 was formed from the resulting vulcanized rubber sheet, and ordinary properties and heat aging properties of the vulcanized rubber after heat aging at 100° C. for 96 hours were evaluated.

In Tables 7 and 8 below, a hardness was measured according to JIS K 6253 (with a durometer type A), and an elongation at break, a modulus and a tensile strength were measured according to JIS K 6251.

TABLE 7

Ordinary properties

| Rubber process oil | Example 10 | Example 11 | Comparative Example 3 |
|---|---|---|---|
| Hardness (JIS)(Hs) | 46 | 46 | 46 |
| Elongation at break (Eb %) | 740 | 720 | 760 |
| Modulus (MPa)*1 | 4.8 | 4.6 | 4.6 |
| Tensile strength (MPa) | 15.8 | 15.6 | 15.4 |
| Bleeding (visual observation)*2 | no | no | no |

Notes)
*1Stress when an elongation at break is 300% (M-300).
*2Bleeding was evaluated by visually observing the surface of the specimen after it was vulcanized and then allowed to stand at room temperature for 3 days.

TABLE 8

Heat aging properties (aging conditions: 100° C., 96 hours)

| Rubber process oil | Example 10 | Example 11 | Comparative Example 3 |
|---|---|---|---|
| Hardness (JIS)(Hs) | 54 | 54 | 55 |
| Elongation at break (Eb %) | 380 | 380 | 400 |
| Modulus (MPa)*1 | 9.6 | 9.5 | 9.2 |
| Tensile strength (MPa) | 12.8 | 12.6 | 12.4 |

Note)
*1Stress when an elongation at break is 300% (M-300).

From the results, it becomes apparent that in Examples 10 and 11, the PCA content is less than 3% by weight and the ordinary properties and the heat aging properties which are the same as those given when using ordinary oil in Comparative Example 3 (PCA content=15.6% by weight) are shown without occurrence of bleeding.

What is claimed is:

1. A process for producing process oil having a content of a polycyclic aromatic compound of less than 3% by weight, which comprises extracting mixed oil made of 20 to 90% by volume of residual oil and 10 to 80% by volume of lubricant base oil with a polar solvent.

2. The process for producing process oil as claimed in claim 1, wherein the process oil further satisfies requirements that (b) a content of an aromatic hydrocarbon is 18% by weight or more, (c') a content of a polar compound is 25% by weight or less, and (d) a kinematic viscosity at 100° C. is between 10 and 70 $mm^2/s$.

3. The process for producing process oil as claimed in claim 1, wherein the extraction is conducted by a countercurrent contact method with an extraction column using furfural as a polar solvent under conditions that a solvent ratio (polar solvent/mixed oil volume ratio) is between 0.5 and 2.5, an extraction column top temperature is between 60 and 115° C., an extraction column bottom temperature is between 45 and 80° C., and the extraction column top temperature is higher than the extraction column bottom temperature.

4. A process for producing process oil as claimed in claim 2, wherein the extraction is conducted by a countercurrent contact method with an extraction column using furfural as a polar solvent under conditions that a solvent ratio (polar solvent/mixed oil volume ratio) is between 0.5 and 2.5, an extraction column top temperature is between 60 and 115° C., an extraction column bottom temperature is between 45 and 80° C., and the extraction column top temperature is higher than the extraction column bottom temperature.

5. The process for producing process oil as claimed in claim 1, wherein the process oil satisfies requirements that (a) a content of a polycyclic aromatic compound is less than 3% by weight, (b) a content of an aromatic hydrocarbon is 18% by weight or more, (c) a content of a polar compound ranges from 11 to 25% by weight, (d) a kinematic viscosity at 100° C. ranges from 10 to 70 $mm^2/s$, and (e) a flash point is 210° C. or more.

* * * * *